US005203962A

United States Patent [19]

Renquist

[11] Patent Number: 5,203,962

[45] Date of Patent: Apr. 20, 1993

[54] METHOD OF MANUFACTURING AND UTILIZING CELLULOSIC FIBER IDENTIFICATION TAGS FOR WOODEN ARTICLES

[75] Inventor: George A. Renquist, Edmonds, Wash.

[73] Assignee: Moore Business Forms, Inc., Grand Island, N.Y.

[21] Appl. No.: 360,073

[22] Filed: Jun. 1, 1989

[51] Int. Cl.[5] ..... D21C 19/66; D21B 1/32; G09F 3/00

[52] U.S. Cl. ..... 162/4; 162/27; 162/134; 40/299; 40/360

[58] Field of Search ..... 162/4, 27, 1, 134; 118/46; 40/299, 360

[56] References Cited

U.S. PATENT DOCUMENTS

| | | | |
|---|---|---|---|
| 177,917 | 5/1876 | Averill | 162/27 |
| 954,924 | 4/1910 | Brooks . | |
| 2,075,023 | 3/1937 | David | 162/27 |
| 2,412,592 | 12/1946 | Maier . | |
| 2,768,460 | 10/1956 | Northrup . | |
| 2,979,840 | 4/1961 | Eastman . | |
| 3,556,835 | 1/1971 | Sorell . | |
| 3,673,717 | 7/1972 | Latschbacher . | |
| 3,891,497 | 6/1975 | Daane et al. | 162/4 |
| 3,947,983 | 4/1976 | Brunette . | |
| 4,254,187 | 3/1981 | Claybaker . | |
| 4,262,058 | 4/1981 | Saunders . | |
| 4,392,315 | 7/1983 | Irving et al. . | |
| 4,414,258 | 11/1983 | Corbin, Sr. . | |
| 4,574,732 | 3/1986 | Verwey et al. | 118/46 |
| 4,631,845 | 12/1986 | Samuel et al. . | |
| 4,724,166 | 2/1988 | deBruin . | |
| 4,772,518 | 9/1988 | Marthe . | |
| 4,884,265 | 7/1989 | Komori | 118/46 |

*Primary Examiner*—Steve Alvo
*Attorney, Agent, or Firm*—Nixon & Vanderhye

[57] ABSTRACT

Identification and inventorying of logs, particularly those to be made into paper pulp, is provided utilizing a cellulosic fiber (paper) based identification tag. The tag is printed, as by ion deposition, with variable information, such as bar coding and human recognizable indicia corresponding to the bar coding. By perforations, the tag is separated into a number of different sections, each section having the variable imaging on it. A water soluble acrylic varnish is applied to the web to cover the bar coding. The tags are attached to the cut ends of logs by metal staples, and during processing or inventorying sections of the tag may be removed along the perforations.

17 Claims, 1 Drawing Sheet

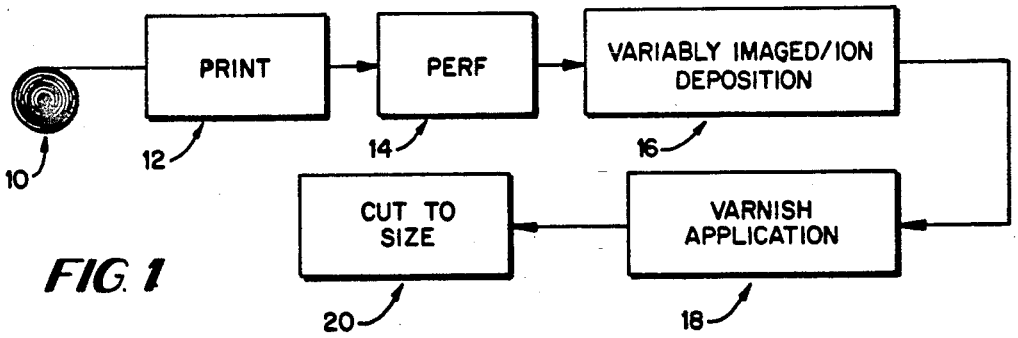
FIG. 1
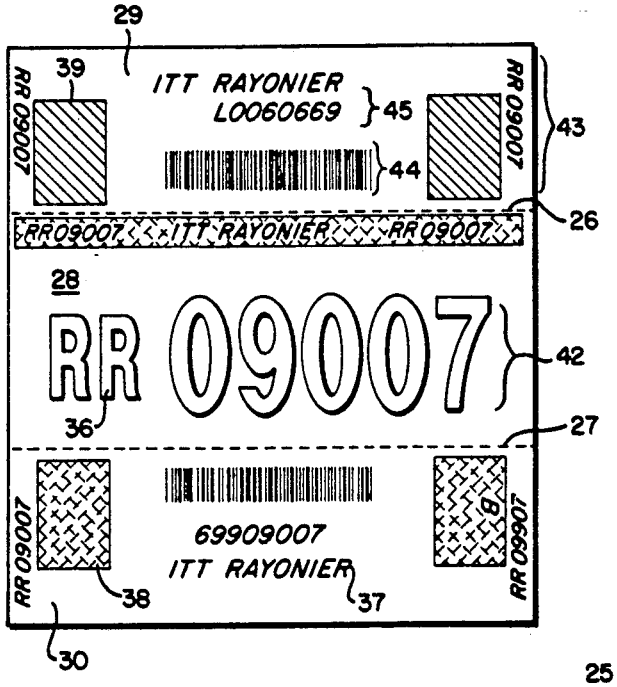
FIG. 2
FIG. 3
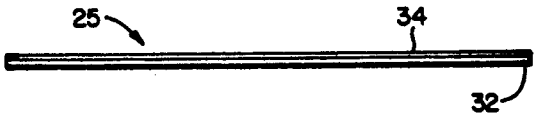
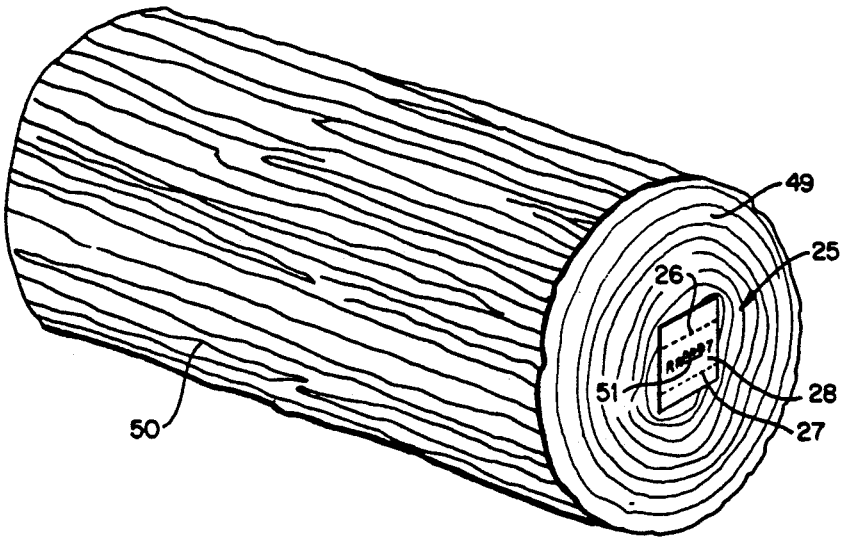
FIG. 4

METHOD OF MANUFACTURING AND UTILIZING CELLULOSIC FIBER IDENTIFICATION TAGS FOR WOODEN ARTICLES

BACKGROUND AND SUMMARY OF THE INVENTION

In the logging industry, it is necessary to identify logs in order to properly inventory and process the logs. Logs typically are used for processing into lumber, or for processing into paper pulp (after the logs are formed into chips). The logs typically have a 30–90 day life span from cutting and delimbing until processed into lumber or pulp, and it is necessary that any identification structures used for the logs survive that 30–90 day life span.

The most common commercial identification structures for logs presently utilized are plastic tags which have imaged bar code (variable information) disposed thereon, and a clear plastic laminate over the imaged bar code. Such tags are typically attached to the cut end of a log with staples, and are capable of surviving total submersion in water, rain, freezing, sunlight, etc. for 120 days or more. However such plastic tags have two major disadvantages.

The first disadvantage of conventional plastic tags is that they are expensive, and the tag specifications are typically inflexible to various customer needs. The most significant disadvantage, however, is that the plastic tags are contaminates to the paper making process. If a log which is to be used for making chips for pulping is not stripped of the plastic tags (the metal staples can remain in the logs as they do not affect the pulping process), an entire batch of pulp can be contaminated beyond use since the pulping process is extremely sensitive to plastic contamination.

According to the present invention, the major disadvantages of the plastic tags set forth above are overcome by the utilization of a cellulosic fiber tag. The tags produced according to the invention—while not as hardy as the plastic tags —are capable of surviving the necessary 30–90 day life span. They are inexpensive to produce, and are versatile so that they can be produced according to a customer's particular requirements. Most important, they are transparent to the paper making process—that is they do not provide a contaminant to the pulp, and thus even if the identification tags according to the invention are not removed from the logs prior to pulping, they will not contaminate the pulping process.

According to one aspect of the present invention, an identification tag capable of lasting 30–90 days attached to a log is provided. The tag comprises a sheet of cellulosic fiber (preferably consisting essentially of cellulosic fiber and a small amount of wet strength resin) having perforations dividing the sheet into at least two distinct sections, and first and second faces. The sheet has dimensions smaller than the cross-sectional dimensions of a log for producing pulp, to which the tag is ultimately stapled. Ion deposition toner (e.g. consisting essentially of carbon black, iron oxide, and a minor amount of polyethylene) is disposed on the first face of the sheet in the form of machine readable (preferably bar coding) and human recognizable variable identifying indicia, comparable variable indicia provided on each of the distinct sections. A varnish, such as a water soluble acrylic varnish, is applied over the indicia on the first face of the sheet.

According to another aspect of the present invention, a method is provided for manufacturing and utilizing cellulosic fiber based identification tags for wooden articles. The method comprises the steps (which may be practiced sequentially) of: (a) Printing a web of cellulosic fiber based paper with non-variable information, if any. (b) Forming perforations in the web to define at least two distinct areas, each area separated by a perforation, for each tag to be formed. (c) Variably imaging variable information, preferably bar coding and human recognizable indicia corresponding to the bar coding, on each area of each tag to be formed. (d) Applying a varnish, such as a water soluble acrylic varnish, to the web to cover the printed non-variable, if any, and variable information. (e) Cutting the web into discrete identification tags, each tag having at least two of the distinct areas. (f) Fastening the tag to a cut end of the log with a non-contaminating fastener (e.g. stapling the tag to the log with metal staples, and (g) making the log into paper pulp without removing the tag.

According to yet another aspect of the present invention there is provided a method of identifying and using a log in the production of paper pulp. The method comprises the step of fastening to a cut end of the log with a non-contaminating fastener a cellulosic fiber identification tag having on one face thereof variable identifying indicia covered by a varnish. Paper pulp is made from the log without removing the identification tag, or metal staples which is used to fasten the tag to the log. The tag preferably has a plurality of sections separated by perforations, each section having bar coding and/or human recognizable indicia corresponding to the bar coding, providing the variable identifying indicia thereon. The method comprises the further step of, during inventorying or processing of the log, removing one of the sections of the tag by tearing it along a perforation while maintaining another section of the tag fastened to the log.

It is the primary object of the present invention to provide for the inexpensive, non-contaminating identification of logs, particularly though not exclusively logs that are to be used in the production of paper pulp. This and other objects of the invention will become clear from an inspection of the detailed description of the invention and from the appended claims.

BRIEF DESCRIPTION OF THE DRAWINGS

FIG. 1 is a is a diagrammatic showing exemplary method steps that may be practiced to produce identification tags according to the present invention;

FIG. 2 is a is a top plan view of an exemplary log identification tag according to the present invention;

FIG. 3 is an end view of the tag of FIG. 2; and

FIG. 4 is a a perspective view of the tag of FIGS. 2 and 3 in use identifying a log.

DETAILED DESCRIPTION OF THE DRAWINGS

FIG. 1 schematically illustrates an exemplary method for production of non-contaminating identification tags according to the invention. Starting out with a web (roll) of cellulosic fiber paper 10, various steps are sequentially performed in the production of the identification tag. The web of paper 10 may comprise any suitable cellulosic fiber paper. The paper typically will have a small amount of wet strength resin, such as melamine formaldehyde, but will not have a significant amount of additional fibers or other materials that might contaminate a pulping process. One particularly suitable paper is that made by Permafiber Corporation of New York, N.Y., having a weight of 120 pounds, known as Permafiber 10 point white.

The web 10 is first passed to a printing station 12 where non-variable information, if any, is printed on it. Preferably the printing station 12 effects printing with a litho non-fade heat resistant ink, such as available from Panatone. The heat resistance of the ink is desired so that it will not degrade as the web passes through an ion deposition printer further in the method sequence.

After the non-variable information is printed at station 12, preferably the paper is subjected to perfing at 14, utilizing conventional perfing equipment. Then the web passes to station 16, an ion deposition printer, where it is variably imaged by ion deposition. Variable imaging takes place utilizing an ionographic toner. One particular toner that is suitable for this use is ionographic toner RP1362 manufactured by Coates Reprographics Inc. of Dallas, Pa. This toner consists essentially of iron oxide (60%), carbon black (5%), and a minor amount of polyethylene (35%). The polyethylene is the only one of these constituents that could possibly be a contaminant to a pulping process, however the amount of polyethylene in the total tag is so low that it will not result in contamination. Other toners having no contaminants whatsoever may be available, and would be desirable if otherwise functional.

After the ion deposition printer, the web 10 is passed to a varnish application stage 18. Any suitable conventional coating apparatus may be used for applying the varnish to the web. Typically the varnish need only be applied to the face of the web on which the non-variable and variable information is printed (typically this information would be printed on only one face of the web). The varnish is preferably completely water soluble, such as an acrylic varnish available under the trade name "Over Print Varnish" manufactured by Arcar Graphics Inc. of West Chicago, Ill. The varnish is more to resist abrasion than to provide a waterproofing, although some waterproofing action is provided since even though the varnish goes on as an aqueous base, once it dries it is highly water resistant.

After a varnish application, the web 10 is cut to size at stage 20 for the identification tags, the identification tags typically being rectangular or square in configuration as illustrated generally by reference numeral 25 in FIGS. 2 through 3, and having a plurality of generally rectangular sections. For example for the embodiment illustrated in FIGS. 2 through 4, the cellulosic fiber identification tag 25 has a middle rectangular section 28, and two end rectangular sections 29, 30 which are opposite each other, separated from each other by perforations 26, 27. As seen most clearly in FIG. 3, the identification tag 25 has a cellulosic fiber base 32 with the varnish overcoat 34 on the face thereof which contains the printing.

The non-variable information printed on the tag 25 as illustrated in FIG. 2 comprises the letter indicia 36, word indicia 37, and orange and green color areas 38, 39, etc. The variable information includes the human recognizable numerical indicia 42, 43, the bar coding 44 or like machine recognizable indicia, and the additional human recognizable numerical indicia 45. The bar coding may be 4.5 characters per inch, 7.0 characters per inch, or other suitable forms depending upon the particular needs of a specific customer. Note that the variable information is printed on all three sections 20 through 30 of the tag 25, the sections being separable by tearing along the perforations 26, 27. The bar coding 44 is preferably printed on at least the two end sections 29, 30.

The identification tag 25 according to the invention is useful for identifying all sorts of wooden articles or the like. Its greatest utility, however, is in the identification of logs, particularly logs that will be processed into paper pulp, in view of the non-contaminant features and inexpensiveness thereof. The term "non-contaminating" as used in the specification and claims refers to the fact that a conventional paper pulping process is not contaminated.

A typical utilization of the identification tag 25 according to the invention is illustrated in FIG. 4 where a tag 25 is applied to the cut face 49 of a log 50 utilizing a metal staple 51. The staple is applied to only the middle section 28 of the tag 25. During inventorying and processing of the log 50, typically one or both of the end sections 29, 30 will be removed by folding and tearing along the perforations 26, 27. The bar coding 44 on one or both of those sections will be read by an optical scanner, but the human recognizable indicia 42 or the like provided on the center section 28 would typically remain on the log. While it still may be desirable to remove the tag 25 from the log before it is processed into paper pulp, due to the non-contaminating nature of the tag 25 if it is not removed there will be no significant adverse impact on the pulping process. Despite the inexpensiveness, versatility, and non-contaminating nature of the tag 25, it will survive the 30–90 day life in an outdoor environment that the log 50 typically would be subjected to.

It will thus be seen that according to the present invention a method and product are provided which overcome the drawbacks associated with conventional plastic tags for identifying logs. While the invention has been herein shown and described in what is presently conceived to be the most practical and preferred embodiment thereof, it will be apparent to those of ordinary skill in the art that many modifications may be made thereof within the scope of the invention which scope is to be accorded the broadest interpretation of the appended claims so as to encompass all equivalent products and procedures.

What is claimed is:

1. A method of manufacturing and utilizing cellulosic fiber based identification tags for wooden articles, comprising the steps of:

(a) printing a web of cellulosic fiber based paper with non-variable information, if any;

(b) forming perforations in the web to define at least two distinct areas, each area separated by a perforation, for each tag to be formed;

(c) variably imaging variable information on the web, the variable information provided on each area of each tag to be formed;

(d) applying a varnish to the web to cover the printed non-variable, if any, and variable information; and (e) cutting the web into discrete identification tags, each tag having at least two of said distinct areas.

2. A method as recited in claim 1 wherein said steps (a) through (e) are practiced sequentially.

3. A method as recited in claim 1 comprising the further step of (f) fastening the tag to the cut end of a log with a non-contaminating fastener.

4. A method as recited in claim 3 wherein step (c) is practiced by effecting ion deposition of a toner containing iron oxide, carbon black, and a minor amount of polyethylene.

5. A method as recited in claim 3 comprising the further step of (g) making the log into paper pulp without removing the tag.

6. A method as recited in claim 5 wherein step (d) is practiced by applying a water soluble acrylic varnish to one face of the web.

7. A method as recited in claim 1 wherein step (c) is practiced by ion deposition.

8. A method as recited in claim 7 wherein step (c) is further practiced by effecting ion deposition of a toner containing iron oxide, carbon black, and a minor amount of polyethylene.

9. A method as recited in claim 7 wherein step (c) is further practiced to provide bar coding as well as human recognizable indicia corresponding to the bar coding.

10. A method as recited in claim 9 wherein step (d) is practiced by applying a water soluble acrylic varnish to one face of the web.

11. A method as recited in claim 10 wherein step (c) is further practiced by effecting ion deposition of a toner containing iron oxide, carbon black, and a minor amount of polyethylene.

12. A method as recited in claim 1 wherein step (d) is practiced by applying a water soluble acrylic varnish to one face of the web.

13. A method as recited in claim 12 wherein step (a) is practiced by printing a web consisting essentially of cellulosic fiber and wet strength resin.

14. A method as recited in claim 1 wherein step (a) is practiced by printing a web consisting essentially of cellulosic fiber and wet strength resin.

15. A method as recited in claim 1 wherein step (b) is practiced by dividing the web by perforations into a middle rectangular section, and two opposite end rectangular sections.

16. A method as recited in claim 15 wherein steps (a) and (c) and (e) are practiced so that each identification tag has a middle rectangular section and two opposite end rectangular sections, each end section having bar coding and human readable indicia thereon, and the middle section having at least human readable indicia thereon.

17. A method of manufacturing and utilizing cellulosic fiber based identification tags for wooden articles, consisting of the steps of:

(a) printing a web of cellulosic fiber based paper with non-variable information, if any;
(b) forming perforations in the web to define at least two distinct areas, each area separated by a perforation, for each tag to be formed;
(c) variably imaging variable information on the web, the variable information provided on each area of each tag to be formed;
(d) applying a varnish to the web to cover the printed non-variable, if any, and variable information;
(e) cutting the web into discrete identification tags, each tag having at least two of said distinct areas;
(f) fastening the tag to the cut end of a log with a non-contaminating fastener; and
(g) making the log into paper pulp without removing the tag.

* * * * *